United States Patent [19]

Pidcock

[11] 4,307,885

[45] Dec. 29, 1981

[54] GOLFER'S SIGHTING AID FOR PUTTING

[76] Inventor: Paul M. Pidcock, 395 Ross Ave. East, Timmins, Ontario, Canada, P4N 5X4

[21] Appl. No.: 182,217

[22] Filed: Aug. 28, 1980

[51] Int. Cl.[3] ..... A63B 69/36

[52] U.S. Cl. ..... 273/183 B; 350/298; 2/185 R

[58] Field of Search ..... 2/10, 199, 185 R, 422; 350/103, 105, 97, 98, 298; 273/183 B, 190 A, 35 A

[56] References Cited

U.S. PATENT DOCUMENTS

| | | | |
|---|---|---|---|
| 397,768 | 2/1889 | Wright | 2/185 R |
| 736,418 | 8/1903 | Merrick | 2/185 R |
| 1,637,406 | 8/1927 | Brumder . | |
| 1,980,101 | 11/1934 | Schneider | 273/190 A |
| 2,009,700 | 7/1935 | McMurdo . | |
| 2,773,411 | 12/1956 | Schwede . | |
| 3,058,392 | 10/1962 | Primeau . | |
| 3,264,002 | 8/1966 | Palumbo . | |
| 3,436,151 | 4/1969 | Conrose . | |
| 3,487,549 | 1/1970 | Engesser . | |
| 3,866,907 | 2/1975 | Goudie . | |
| 3,871,104 | 3/1975 | Underhill . | |

FOREIGN PATENT DOCUMENTS

| | | | |
|---|---|---|---|
| 1373772 | 11/1974 | United Kingdom | 273/183 B |

*Primary Examiner*—George J. Marlo

[57] ABSTRACT

A putting aid to increase a golfer's accuracy on the green is disclosed, comprising a short leg and a long leg hingedly secured to the short leg. The long leg is provided with a plane mirror and the short leg is rigidly secured to the under-surface of the peak of a standard cap worn by the golfer and at an angle of 45° relative to the forward direction. When the golfer takes his stance for putting, an image of the flag pin making a direct line between the hole on the green and the golf ball appears to the eye closest to the hole. At the same time, the golfer, without moving his head, can place the putter face at the appropriate angle to the flag pin image which is viewed as connecting the hole and the ball. Coacting magnets and a flat hinge spring are provided to maintain the long leg in both a housed position and a viewing position, respectively.

3 Claims, 7 Drawing Figures

GOLFER'S SIGHTING AID FOR PUTTING

FIELD OF THE INVENTION

The present invention relates to accessories for sports activities, more specifically to a putting aid designed to improve a player's skill at the putting aspect of the game of golf.

BACKGROUND OF THE INVENTION

Various devices have been proposed in the prior art to assist a player who has reached the putting green stage of the game. For example U.S. Pat. No. 2,009,700 teaches the use of a specially modified pair of glasses for improving golf strokes. However, this device is not directed specifically to putting. U.S. Pat. No. 3,264,002 also teaches the use of a modified pair of glasses having a "linear member" whereby a line between the ball and the cup on the green may be "vaguely seen". Yet another patent (U.S. Pat. No. 3,436,151) proposes the use of spectacles with an "infinity sight" wherein an imaginary line is created from the ball to the hole on the green. This invention requires cylindrical boss integral with one of the lens of the spectacle to create the imaginary line. Yet another patent (U.S. Pat. No. 3,058,392) proposes a device, but it is designed for looking at objects in front of the user.

OBJECTS OF THE INVENTION

It is an object of the present invention to provide a putting aid which is very simple to operate and inexpensive to produce.

It is another object of the present invention to provide a putting aid which creates a real or imaginary focused and clearly visible putting line between the ball and the hole in the green.

It is still another object of the present invention to provide a putting aid which eliminates the need for a player to commit the orientation of the putting line to memory by permitting the player to see both the putting line and the putter face at the same time without head movements.

It is yet another object of the present invention to provide a putting aid which will not inconvenience a player when playing off the tee or on the fairway or in a hazard.

It is yet another object of the invention to provide a putting aid which may be used effectively by a player using prescription or sun glasses.

SUMMARY OF THE INVENTION

The above and other objects of the instant invention are realized in accordance with the preferred embodiment comprising a golfer's normally used headdress having a horizontal frontwardly extending peak and utilizing a device secured to the undersurface of the peak.

The putting aid consists of a first leg secured to the underside of the peak of the headdress such as a head band or a cap. A second leg is hingedly secured to the first leg such that it may be swung from a viewing position which is substantially vertical as the golfer takes his stance before lowering his head to concentrate on the ball for putting, to an inoperative or housed position wherein it is flush with the first leg and the peak of the cap. Means are provided to maintain the second leg in both viewing and housed positions, as needed on or off the green.

The lower part of the inner surface portion of the second leg is provided with a reflective mirror surface.

The putting aid operates in the following manner: the legs of the device are positioned in such a way that when the golfer using the device lowers his head to look at the ball prior to the putting stroke, and from any putting range, an image of the flag pin will appear to the eye closest to the hole (the left eye if the player is right handed and the right eye if the player is left handed) while the other eye will have an unobstructed direct view of the ball and the face of the putter just behind it. The flag pin will appear in the reflecting surface of the mirror to be substantially horizontal and making an uninterrupted and clearly visible line between the hole and the ball to be putted. The putter face need only be oriented to a right angle position with respect to the line of the flag pole for a successful put. Of course, if a roll of the putting green is indicated, the player need only compensate by making a slight adjustment of the angle of the putter face relative to the perceived line of the flag pole as seen in the reflective surface or relative to the imaginary line between the cup and the ball.

It is known that golfers rely on various methods to evaluate the line in which a ball should be putted. The majority of golfers make several visual observations in the direction of the hole. Each time the head rotates so the eyes may return for a direct view of the ball. The evaluated putting line must remain in the player's memory, and it is to this memorized line that the player, presently with difficulty, has to adjust the putter face so that it creates a right angle with the estimated perfect putting line. The necessity of moving the head several times causes a distraction which has been eliminated by the putting aid of the present invention. Also eliminated are cumbersome supports constituted by spectacle frames.

The above will be more clearly understood by having referral to the preferred embodiment of the invention, illustrated by way of the accompanying drawings, in which:

BRIEF DESCRIPTION OF THE DRAWINGS

Like numerals refer to like elements throughout the drawings.

DETAILED DESCRIPTION OF THE INVENTION

Figure 1:
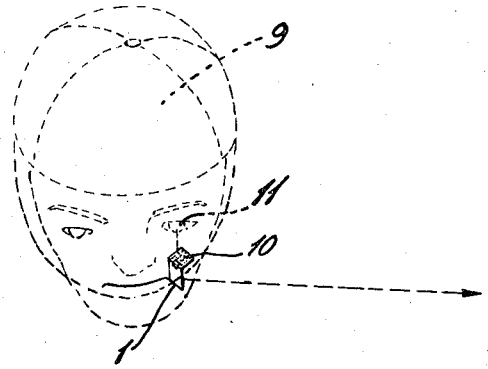
FIG. 1 is a perspective view of a golfer's head and peaked cap in dashed outline, also showing the putting aid installed on the under-surface of the peak with the dashed arrow representing the line of sight.

The putting aid 1 comprises a reflective device consisting of a short leg 2, flat and generally rectangularly shaped and a long leg 3 also flat and rectangular and approximately twice as long as the short leg 2. It is to be noted that both legs 2 and 3 need only be approximately 2 mm in thickness.

Short leg 2 and long leg 3 are hingedly joined together at 4 by means of piano hinge elements 5 and hinge pin 6. Stop means are provided (not shown) to prevent long leg 3 from opening past a limit angle of between 80 and 100 degrees relative to short leg 2.

Figure 6:
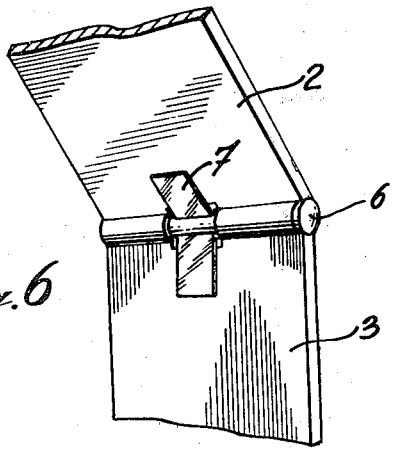
FIG. 6 is a perspective view of the hinge connection between the two legs, both of the latter being broken away.

A flat spring 7 is provided to bias the long leg 3 to viewing position. The angle between the two legs is exaggerated in FIG. 6 to clearly show flat spring 7.

Figure 3:
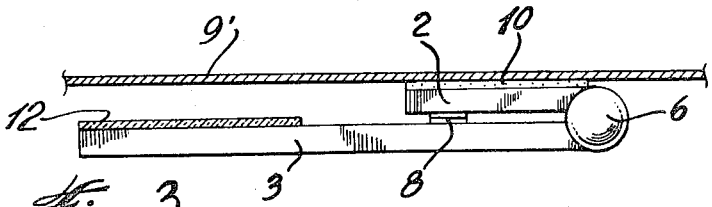
FIG. 3 is a side elevation of the putting aid in housed, non-viewing position.
Figure 5:
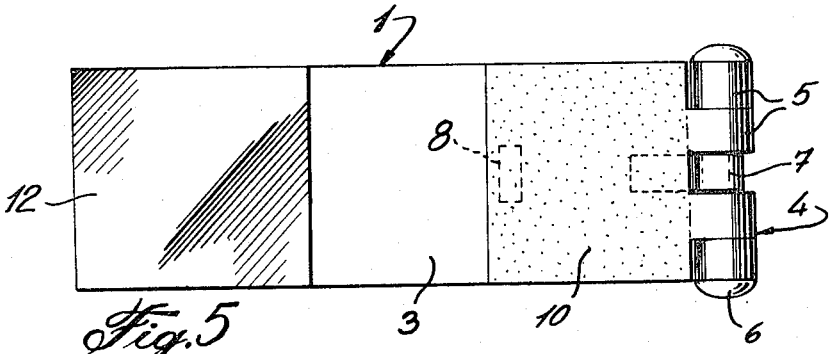
FIG. 5 is a top plan view of the putting aid in non-viewing position.
Figure 4:
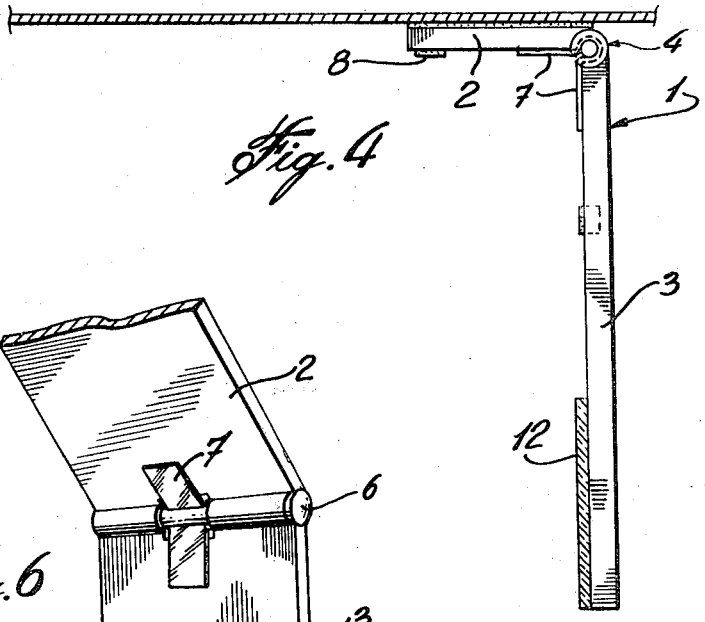
FIG. 4 is a side elevation of the peak of the cap (in cross-section) and the putting aid attached thereto in viewing position.

A pair of permanent magnets 8, one on the inner surface of long leg 3 and one on the facing surface of short leg 2 are adapted to maintain long leg 3 in housed position (as shown in FIG. 3) against the action of flat spring 7. This is to afford both eyes an unobstructed view of the ball when a player is playing off the tee or on the fairway or from a hazard.

Figure 2:
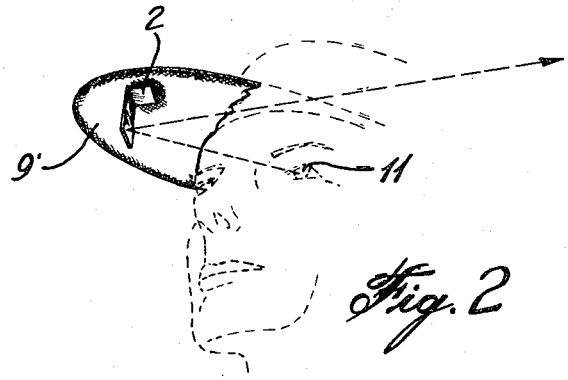
FIG. 2 is a second perspective view of a golfer's head in dashed outline and the peak of the cap with the putting aid installed in viewing position.

The invention also comprises as a necessary element a substantially horizontal frontwardly projecting peak 9' of golfer's cap 9 or head band. The short leg 2 is fixed to the undersurface of peak 9' by a layer of adhesive 10. As seen clearly in FIGS. 1 and 2, short leg 2 is rigidly fixed at an angle of approximately 45 degrees relative to the eye 11 of the player such that long leg 3 is at the same angle in a vertical plane when in viewing position.

The lower inner surface portion of long leg 3 is provided with a reflective surface consisting of a plane mirror 12.

It will be readily appreciated that, when a player using the putting aid lowers his head to a horizontal position to look at the ball to be putted, the peak 9' becomes vertical and the plane mirror 12 assumes an inclined position, sloping downwardly toward the hole 13 on the green. Thus, the image appearing to the left eye 11 of the player (the right eye if the player is left handed) in mirror 12 will be that of the cup or hole 13 and of the flag pin 14 (if present) wherein that latter will seem to be horizontal and making a straight line between the hole 13 and the ball 15 and the face of the putter 16, wherein ball 15 and putter 16 are seen with the other eye. Thus, all a player has to do is to position putter 16 at a right angle or another estimated angle to the direction indicated by the image of flag pin 14, or by the imaginary line between the cup 13 and the ball 15, and putt the ball.

Figure 7:
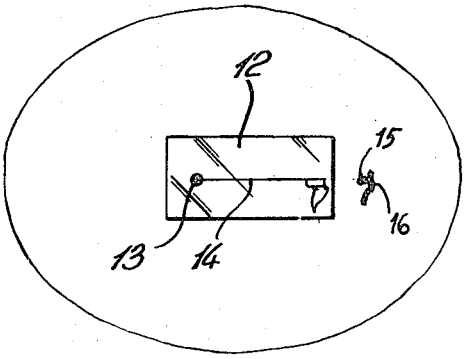
FIG. 7 is a top plan view of the image which is perceived by the two eyes of a golfer using the putting aid with the oval outline representing part of the putting green.

If necessary, the cap 9 may be adjusted horizontally or vertically on the head of the player to obtain a true straight flag pole image in the eye 11 and which should approximately bisect the surface of the mirror, as indicated in FIG. 7.

What I claim is:

1. A putting aid comprising a reflective device permitting lateral viewing of a golf pole and its associated upright flagpole and consisting of first and second legs hingedly secured together; a golfer's headdress having a generally horizontal frontwardly-extending peak wherein said first leg is rigidly secured to the undersurface of said peak at an angle of 45 degrees relative to the frontward direction, said second leg being provided at its inner surface with a plane mirror; said device being provided with a first means to maintain said second leg in a viewing position wherein the latter is at an angle of approximately 90 degrees relative to the first leg, and a second means to maintain said second leg in a non-viewing and non vision-obstructing housed position, wherein the latter lies flat against said first leg under said peak; wherein said plane mirror when in viewing position is located directly in front of and makes approximately a 45-degree angle with the eye closest to the hole of a player about to putt a golf ball; whereby a player taking his stance and having his head bent downwardly sees with said eye an image of the flagpole on the green making a direct line between said hole and said golf ball, said flagpole bisecting said image in said plane mirror and directly sees with the other eye the golf ball and the putter behind said ball.

2. A putting aid as defined in claim 1, wherein said first means is a flat spring located in the hinge elements of said two legs and said second means is a pair of permanent magnets, one being mounted on said first leg and the other on said second leg.

3. A putting aid as defined in claim 1, wherein said short leg is provided with a stop means to prevent said long leg from pivoting past a limit angle of between 80 and 100 degrees relative to said short leg when in use position.

* * * * *